United States Patent [19]

Baumann et al.

[11] Patent Number: 4,649,982

[45] Date of Patent: Mar. 17, 1987

[54] LIFT-SAFETY FOR VENETIAN BLINDS

[75] Inventors: Willi Baumann; Hans-Peter Baumann, both of Horgen, Switzerland

[73] Assignee: Baumann AG Rollandenfabrik, Switzerland

[21] Appl. No.: 610,248

[22] Filed: May 14, 1984

[30] Foreign Application Priority Data

May 18, 1983 [CH] Switzerland ..... 2701/83

[51] Int. Cl.[4] ..... E06B 9/30

[52] U.S. Cl. ..... 160/172

[58] Field of Search ..... 160/172, 168, 169, 170, 160/176, 133

[56] References Cited

U.S. PATENT DOCUMENTS

| | | | |
|---|---|---|---|
| 2,556,352 | 6/1951 | Wellensiek | 160/169 |
| 3,744,544 | 7/1973 | Wellensiek | 160/172 |
| 4,224,973 | 9/1980 | Hugin | 160/178 R |
| 4,324,284 | 4/1982 | Frei | 160/172 |
| 4,444,242 | 4/1984 | Amsler et al. | 160/172 |

FOREIGN PATENT DOCUMENTS

| | | | |
|---|---|---|---|
| 134505 | 9/1902 | Fed. Rep. of Germany | 160/133 |
| 2034321 | 7/1970 | Fed. Rep. of Germany | 160/172 |
| 2425854 | 12/1975 | Fed. Rep. of Germany | 160/133 |
| 2559982 | 6/1977 | Fed. Rep. of Germany . | |
| 2830753 | 1/1980 | Fed. Rep. of Germany . | |
| 3037733 | 7/1982 | Fed. Rep. of Germany . | |
| 1402957 | 4/1964 | France | 160/133 |
| 2177098 | 11/1973 | France . | |
| 2251698 | 6/1975 | France . | |

*Primary Examiner*—Ramon S. Britts
*Assistant Examiner*—Cherney S. Lieberman
*Attorney, Agent, or Firm*—Ostrolenk, Faber, Gerb & Soffen

[57] ABSTRACT

A venetian blind is disclosed having a drive transmission, a lift safety, and an anti-twist safety. The slats are arranged in a stationary frame, and a movable carriage is coupled to at least one of the slats. The carriage moves along a part of the stationary frame for raising and lowering the slats. The lift safety includes a lever or locking pawl mounted on the carriage and positioned to be engaged by a projection on a lift chain or strap. The lever is mounted on the carriage so that the distance between the point of mounting and a point of contact between the lever and the stationary frame decreases as the lever becomes perpendicular to the raising direction. As a result, the lever locks the carriage in position at unauthorized lifting and stops are positioned on the carriage for holding the lever in the locking position. In addition, when the lever is pulled upward from the locking position, it pivots quickly around one of the stops and away from the stationary frame.

8 Claims, 10 Drawing Figures

LIFT-SAFETY FOR VENETIAN BLINDS

BACKGROUND OF THE INVENTION

1. Field of the Invention

The present invention relates to a lift safety for a venetian blind. More specifically, the invention relates to a lift safety having a carriage which is coupled for moving upward and downward with at least one of the slate of the blind. The carriage moves linearly along stationary frame parts of the blind, and has at least one stop-pawl lever on it. The lever swings about a swing point in relation to the carriage within the plane in which the blind lifts. The end of the stop-pawl lever comes into frictional contact with one of the frame parts. The lever is clamped against that frame part by linear displacement of the swing point upon the raising of the carriage.

The invention also relates to a drive transmission for the lowering and raising of a venetian blnd, an anti-twist safety for slats of venetian blinds and a venetian blind having at least one of these devices. More specifically, the invention relates to a drive transmission for the lowering and raising of a venetian blind by means of a first strap-like element and for the tilting of the slats by means of a second strap-like element. The first element travels on a drive member while the second is mounted on a driver arrangement which is mounted for rotary movement with respect to the drive member.

2. Description of the Prior Art

German Application DE OS No. 30 37 733 discloses one such lift safety to prevent unauthorized raising of the slats of a venetian blind. A locking lever is provided on a carriage which is longitudinally displaceable in guides. The lever's length is greater than the distance between its point of swing on the carriage and the portion of the carriage guides against which the lever engages. Upon unauthorized raising of the carriage i.e. upon raising the blind without the drive device provided for raising or lowering it, the lever engages the corresponding portion of the carriage guide and locks against the guide. Once locked, the lever remains in a position in which it is inclined obliquely with respect to the raising direction.

This known lift safety has the following disadvantages: Due to the fact that the lever locks in a position inclined at an oblique angle with respect to the raising direction of the blind, the safety may gradually give way due to vibrations of the carriage. The lever cannot be dimensioned in such a manner that it is eventually pressed by continued raising of the carriage into a more stable perpendicular position with respect to the raising direction because the lever length would then have to be fitted very precisely to the distance between its point of swing on the carriage and the lock-guide portion in order that the pawl would swing into the locking position. On the other hand, large tolerances with respect to the dimensions and the nature of the surface of the carriage guides must be taken into account. These tolerances make designing of a lever as mentioned above problematical.

A drive arrangement is also disclosed in the above-mentioned German Application DE OS No. 30 37 733. A drive wheel of a lifting tape is driven by a shaft for lowering or raising the blind. The drive wheel is connected to a driver device through a coil spring arranged on the circumference of the shaft. The driver device comprises a bushing which is coaxial to the shaft and is seated over the coil spring. The coil spring acts as a frictional coupling between the drive wheel and the drive device and the drive arrangement as long as the ends of the coil spring extending through the bushing are not in contact with stops. The desired stops are arranged in the paths of the spring ends, which act as counterstops, so that the torsion spring comes in contact with one of the stops upon the raising or lowering of the blind. In positions of the blind in which the inclination of the slats is to be changed, however, the spring is released. This permits the drive arrangement to turn with the drive wheel.

This arrangement has the disadvantage of a relatively complicated construction. Also, upon normal raising and lowering of the blind, friction must be overcome. With the torsion spring stopped and fixed against rotation, this friction is produced between the drive wheel's shaft and the spring. As a result, the drive unit must be designed with due consideration of this friction. The friction must not be less than a certain amount, because this friction is necessary for the rotary connection between the drive wheel and the drive device.

SUMMARY OF THE INVENTION

One object of the present invention is to provide a lift safety of the type described above, but which permits an extremely reliable locking of the carriage to prevent unauthorized raising of the blind and which operates substantially independently of the tolerances in the dimensions of the frame part to which it locks.

This result is achieved by mounting the lever on the carriage so that the distance from the end-position locking portion to the swing angle of the lever on the carriage decreases as the swing angle of the lever with respect to the raising direction of the blind approaches 90°. As a result, the lever can be swung into a locking position perpendicular to the raising direction. The carriage will be locked in that position even through the lever has an oversized distance between its swing point on the carriage and the opposing point of contact on the frame at the start of the locking swing. For the lever to reach the perpendicular locking position, a maximum pressing force must be temporarily exceeded along its swing path so that it snaps into the perpendicular, stable locking position.

In order to decrease the distance from locking portion to swing point as the lever swings, the lever is preferably mounted on the carriage by means of a mortise and tenon connection. The mortise is defined by a curved opening in the lever or carriage. The curve of the opening is given by vectors starting at the locking portion, the magnitude of which diminishing as the angle of these vectors raises in a direction opposed to raising direction of the blind.

Furthermore, in order to prevent the lever from being swung further then the perpendicular locking position by forcing the carriage upward, a stop for the lever may be provided on the carriage.

The carriage is preferably connected to the lowermost blind slat. After the carriage and the connected blind slat have been raised in the manner described above and clamped fast by the action of the lever, it will be necessary to disengage the lever. For satisfactory disengagement, it is essential that the lever be swung over the shortest possible path out of engagement with the frame part when the blind and thus the carriage are later lifted by means of a lift drive, such as a lift rope or lift chain. This rapid swinging must also occur despite structural irregularities and tolerances of the frame parts against which the lever locks.

The invention achieves these features on a lift safety of the type described above. The lever can be engaged by a lift drive for the blind at a point between a mounting or swing point on the carriage and a locking portion against the frame part. A rotation stop is provided on the carriage. The lever comes to rest against the stop upon reaching a swing angle of at least approximately 90° with respect to the raising direction. The engagement of the lever by the drive lies between this stop and the locking portion of the lever in such a manner that when the lever is swung out of the perpendicular locking position by the drive, the lever first swings around this stop.

In this way, when the lever starts to swing back out of the locking position, it turns around the stop first. This results in a shortened turning radius compared with the swing radius between the locking portion and the swing point or lever mount on the carriage, whereby the delocking movement component of the locking portion or part i.e. perpendicularly to the frame portion is increased. This rotation stop also ensures that when the carriage is unauthorisedly pushed down the lever is forced into the locking position, the lever again having an increased swing radius, so that the perpendicular locking position of the lever is stabilized.

For improved engagement of the locking part against the corresponding frame part as the lever swings toward the locking position, the locking part of the lever may be edge shaped.

Another object of the present invention is to eliminate the disadvantages in a drive transmission of the type described above and to provide a drive transmission with relatively simple structural means. In the drive transmission of the invention, the drive member for a first strap-like element, such as a raising or lowering cord, is connected, in predetermined positions of the blind, with a driver arrangement for a second-strap like element, such as another cord for the tilting of the slats.

The drive transmission of the invention includes a coupling element which can couple at least one driver to the first strap and thereby to a transmitter. At least one spring arrangement is provided between the transmitter and the driver arrangement which spring arrangement may be spanned upon relative rotation of these parts.

A rotation stop arrangement is also provided for limiting the path of rotation of the driver arrangement with respect to a housing part at least in one direction. These components are arranged so that the movement of the first strap, after it passes through a predetermined position, is transmitted through the driver, coupling element, transmitter and spring arrangement to the drive arrangement until is reaches a position of rotation fixed by the rotation stop arrangement. At this position, the spring action of the spring arrangement opposes relative rotation between the drive member and driver arrangement.

In this way, the spring arrangement remains completely inactive when the transmitter is not coupled to the first strap, such as during the normal raising and lowering of the blind. Only when the first strap is coupled through the driver to the transmitter and the transmitter acts on the spring arrangement, is the driver arrangement moved by the spring arrangement. This does not, however, place tension on the spring, since at this time no relative rotation takes place between the transmitter and the driver arrangement, both of which travel with the drive member. Eventually, the stop member blocks the path of rotation of the driver arrangement in one direction of rotation or the other. Therefore, the driver arrangement is only prevented from rotating when it reaches one of the stop members, while the transmitter may move further. The spring arrangement is then tensioned and acts in this phase as a slow-down safety, since, ordinarily, a drive for the drive member, such as an electric motor, can not come to a standstill in a precisely predetermined angular position.

The coupling element preferably comprises at least one engagement member which is mounted on the transmitter and extends into the path of movement of at least one driver on the first strap. This engagement member cooperates with the first strap to produce a swinging motion of the slats in the raised position or in the lowered position of the blind, for example. By providing two engagement members, the swinging can be obtained in both positions.

The coupling element on the transmitter may be mounted displaceably, preferably under spring tension. The coupling element may engage in a predetermined position with the housing and be displaceable from that position by the driver. This detent connection of the coupling element and the housing renders ineffective any moment of rotation which could be transmitted to the transmitter by friction as long as the driver does not displace the coupling element.

A simple construction results if the coupling element includes a spring tensioned slide. This slide may be guided radially on the transmitter, with an indentation or bulge engaging a corresponding bulge or indentation on the housing in a predetermined position of rotation. In that position of rotation, the driver on the strap may displace the slide tangentially approximately parallel to the radial guiding of the slide on the transmitter to disengage the slide from the housing.

The transmitter may further comprise a cylindrical sleeve seated on a drive shaft on the drive member and within the driver arrangement. A torsion spring may be interposed between the transmitter and the driver arrangement as a spring element. As mentioned above, the torsion spring provides a torsion coupling between the transmitter and the driver arrangement which is placed under tension only when these two parts are rotated relative to each other. The torsion spring has the further advantage that the tensioning of the connection between the transmitter and the driver arrangement can take place in both relative directions of rotation. As as result, a drive unit, such as an electric motor, is protected from over-rotation in both directions.

The drive transmission of the invention provides a nearly rigid rotary connection of the drive member for raising and lowering the blind and the driver arrangement for inclining the slats.

If the individual slats of a venetian blind are positively connected to each other for tilting, the problem arises that the blind may be damaged if e.g. the lowermost blind slat comes against an object which impedes the tilting movement, preventing the swinging of that slat. In accordance with another aspect of the present invention, an anti-twist safety for slats of venetian blinds is provided for this and other situations. The slats, can not only be lowered and raised on lateral slat holders, but can also be tilted. For tilting the slats, the slat holder is connected with a tilting arrangement which swings relative to the slat holder around the tilt axis. A release device between tilting arrangement and holder responds to a predetermined tilting moment and releases the slat holder.

Because the tilting arrangement and the slat holder can swing relative to each other, the connection of the tilt drive to the slat can be released. When the slat is stopped in a manner preventing it from swinging and when the predetermined tilting moment is reached on the tilting arrangement on that slat, the tilting arrangement and the slat holder are released to swing relative to each other. The tilting arrangement can then operate as if it were tilting or swinging the stopped slat in the same way as the other slats. The swinging or tilting movement will not damage the stopped slat.

The release device is preferably an engagement arrangement between the slat holder and the tilting arrangement. It may take the form of a pawl connection.

Furthermore, the tilting arrangement may be prevented to an extent from swinging with respect to the slat holder, even when released, by a force exerted by a spring. The spring will cause the tilting engagement to reengage with the slat holder when the obstacle prevents the swinging of the slat is removed. The slat held by the spring is driven into the intended tilting position. Furthermore, the slat holder and the tilting arrangement are preferably held axially against each other by a spring member. As a result, the release of the rotary connection between the tilting arrangement and the slat holder will not lead to a fluttering of the slats, as under the influence of the wind. Also, such a fluttering will not occur even if the tilting arrangement is not stabilized against the turning of the tilting drive, such as when the drive members are loose. This can occur, for example, if the slat is raised by a lift drive and the tilt drive is thus released.

All the inventive features mentioned, the lift safety, the drive transmission as well as the anti-twist safety, are preferably provided in combination on a venetian blind. As already mentioned, the anti-twist safety may be necessary to protect the drive transmission.

Other objects, features and advantages of the invention will be apparent from the following description, together with the accompanying drawings and the appended claims.

DETAILED DESCRIPTION OF THE PREFERRED EMBODIMENTS

Figure 1:
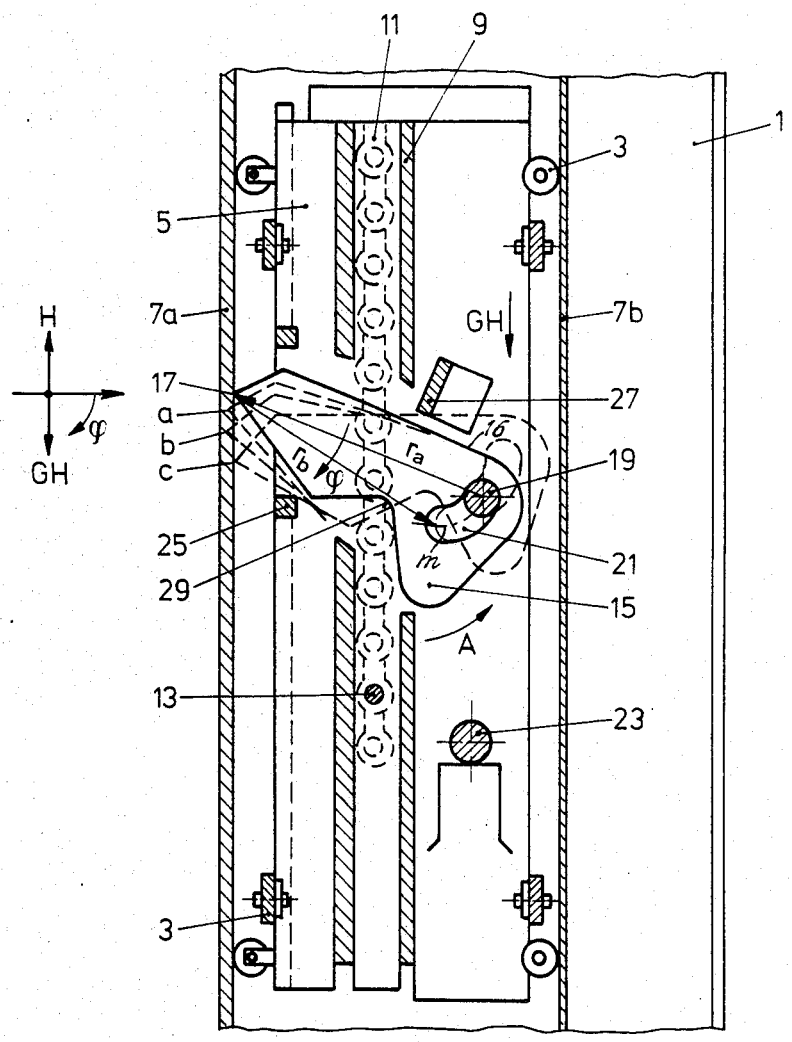
FIG. 1 is a side view, partially in section, of a lift safety according to the invention, with a locking lever swingable into locking position on a carriage which is at one end of a venetian blind.

FIG. 1 shows a lift safety for a venetian blind according to the invention. Within a blind housing 1, a carriage 5 is mounted on four pairs of rollers 3 for linear displacement along carriage guides **7*a* and 7*b*. Chain guides 9 are provided on the carriage 5 in the form of upwardly extending plates parallel to the carriage guides 7*a* and 7*b* on the housing 1. Chain 11 is between chain guides 9 and is displaceable upward and downward. In the embodiments shown in FIGS. 1 and 2 the chain 11** lies in front of the plane of the drawing, so that it has been shown merely is dashed line.

The chain 11 bears a driver projection 13 at its end which cooperates with a locking lever 15. Locking lever 15 is provided at its end disposed toward guide **7*a* with a locking edge 17 and is mounted on a journal pin 19 on the carriage 5 near the other end, and discussed below. The lever 15 extends from one side of the carriage 5 disposed toward guide 7*b* through corresponding cutouts in the chain guides 9 into the region of carriage guide 7*a*, hereinafter referred to as the locking abutment because locking edge 17** locks against it.

The lever 15 has a guide groove 21 defined in it which fits around and rides on the journal pin 19. The groove 21 is curved in a kidney shape and over its entire length has a width corresponding to the diameter of the journal pin 19. A groove center line m is therefore spaced apart from the locking edge 17 of the lever 15 by locus vectors r, the lengths of which decrease as the angle $\phi$ increases for raising direction H toward lowering direction GH. The swinging movement of the lever 15 around journal pin 19 is limited in the counterclockwise direction by a limiting stop 25 on the carriage 5. In the region of the upper edge 16 of the lever 15 a rotation stop 27 is provided on the carriage 5 the function of which will be described below.

Figure 2:
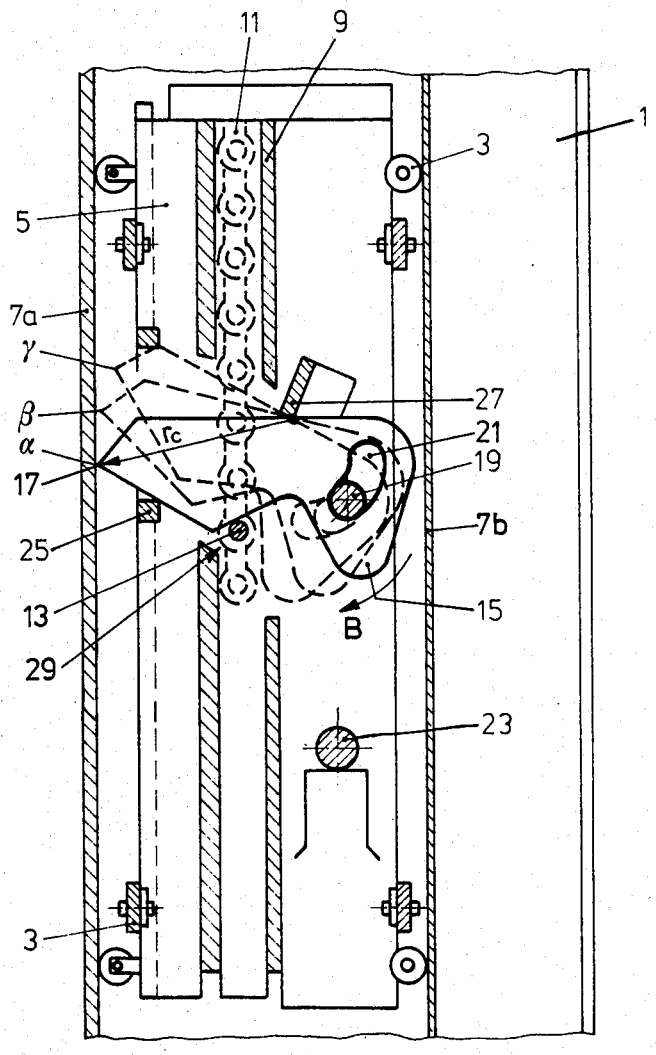
FIG. 2 is a view similar to FIG. 1, showing the lever moving out of the locking position.

The lift safety of FIGS. 1 and 2 operates as follows: The lowermost slat of a venetian blind (not shown) is swingably connected at the slat journal pin 23 to the carriage 5, as shown in FIGS. 1 and 2. The lowermost slat and the carriage 5 are raised or lowered by means of the lowering and raising chain 11. This movement occurs when the driver projection 13 comes against a recess 29 on the lever 15. During this normal raising and lowering operation of the blind and the carriage 5, the lever 15 is against the rotation stop 27.

The lowermost blind slat, fastened to the blind journal pin 23, may be hindered e.g. by an object in its path of movement in the lowering direction GH when the blind and carriage 5 are lowered. When this occurs, chain 11 continues to travel downward and the driver projection 13 comes out of the recess 29 on the lever 15. The lever 15 thus assumes the position shown in solid line in FIG. 1; it tilts in the counterclockwise direction until its locking edge 17 rests against the locking abutment **7*a*. If the path-blocking object is removed from the path of movement of the lowermost slat, then the carriage drops until it again rests on the driver projection 13**.

If in any position, and not by the chain 11, one tries to pull the carriage 5 in the raising direction H, and thus the lowermost slat of the blind, then lever 15 passes through the positions a, b, c, as shown in dashed line in FIG. 1. First the lever 15 just rotates around pin 19 when disengaged from the chain (solid line lever position) whereby the locking edge 17 then describes an arc of radius $r_a$ around pin 19. As, when carriage 5 is lifted, the pin 19 is moved with the carriage linearly upwards, the lever 15 is, when the carriage is further lifted, wedged at locking abutment *7a*, because the radius $r_a$ is greater than the distance between journal pin 19 and locking abutment *7a*.

When the carriage 5 is still further lifted by force the pin 19 is forced to slide along the groove 21 whereby the lever is forced to tilt in the direction A. For this movement the locking edge 17 becomes the pivoting point for the lever 15. By this forced upwards pivoting of that end of the lever with the groove 21 in direction A, the pin 19 slides into the lower region of the groove 21, which has smaller distance $r_b$ from the edge 17, compared with $r_a$ at upper regions of the groove 21. Finally the lever 15 is brought in a position which is practically perpendicular with respect to lift-direction H.

During this swinging movement of lever 15, the locking edge 17 remains to a great extent stationary against the locking abutment *7a* and merely rolls thereon due to the pressing action. Therefore, the lifting force which must be applied to carriage 5 for swinging the lever 15 into this perpendicular position decreases as lever 15 approaches the perpendicular locking position. When guide groove 21 completes its slide along the journal pin 19, and lever 15 swings into the locking position, the upper edge 16 of lever 15 comes into contact with rotation stop 27. Further swinging of lever 15 around edge 17 is prevented by the limiting stops 25 and 27 on carriage 5.

FIG. 2 shows how lever 15 is released from the locking position by lifting chain 11 with the driver projection 13 engaging lever 15. The driver projection 13 meets lever 15 at a point horizontally between the stop points against the limiting stop 25 and against the rotation stop 27. As shown, that part of the guide groove 21 which holds pin 19 in wedged lever position is nearly vertical. Therefore, the rotation stop 27 now acts as a pivot point for lever 15.

The lever 15 thus swings, in a first returnswing phase, around the rotation stop 27, and the locking edge 17 swings on an at least nearly circular path having the radius of curvature $r_c$ around rotation stop 27. This radius of curvature $r_c$ is substantially smaller than the swing radii $r_a$, $r_b$ which determine the path of the locking edge 17 as it moves into the locking position. Due to this reduced radius of path curvature $r_c$, even a slight raising of the driver projection 13 causes the locking edge 17 to swing out of locking contact with the locking abutment *7a*. Lever 15 then slides in the direction indicated by B, whereby the guide groove 21 slides downwards along the journal pin 19 until the journal pin 19 is again against the upper portion of the guide groove 21 and the upper edge 16 is against rotation stop 27 due to the pull of the driver projection 13.

From the arrangement of the rotation stop 27 and the position of the groove 21 when lever 15 is in the perpendicular locking position, it is clear that in this position lever 15 cannot readily be swung back even by pulling on the carriage 5 in the lowering direction GH. Lever 15 thus assumes a relatively stable locking position, until reengagement with chain 11 is performed.

The lift safety of the invention is an extremely reliable measure against unauthorized raising of blinds, such as venetian blinds. Irregularities in the locking abutment *7a* as well as geometrical tolerances providing a broad range in the distance between journal pin 19 and abutment *7a* do not impair the dependable operation thereof. Due to the relatively stable position of the lever 15 in the perpendicular locking position, subsequent loosening of the wedged lever 15 by vibrations on the carriage 5 is also impossible.

Figure 7A:
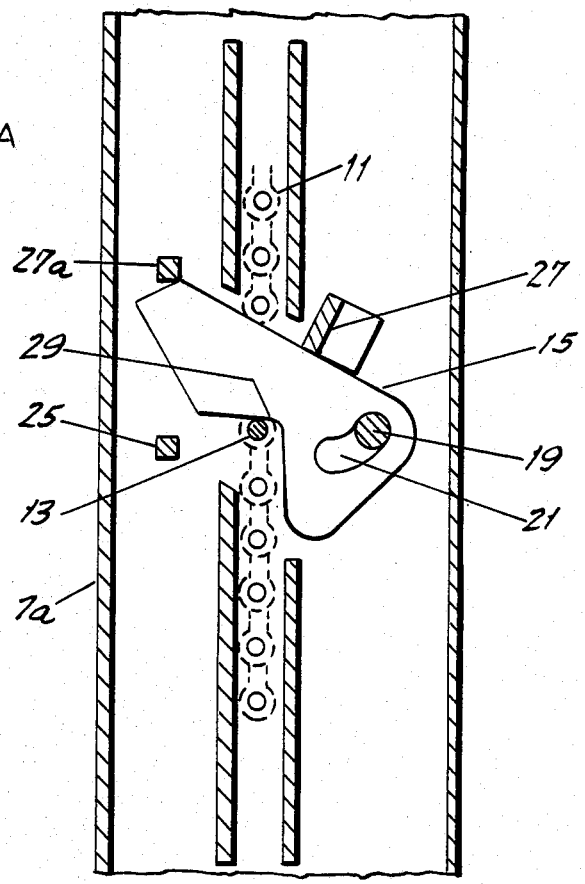
FIGS. 7A, 7B and 7C are side views, partially in section, of a lift safety according to the invention, for use in explaining the operation of the disclosed embodiment of the invention.

The operation of the lever 15 will now be described with reference to FIGS. 7A–7C. Referring to FIG. 7A, there is seen the position of the lever 15 as the carriage assembly is being drawn upward by the chain 11. The chain 11 has moved upward to urge the pin 13, which projects out of the plane of FIG. 7A, against recess 29 in the lever 15. The lever 15 has tilted to its extreme clockwise position. In this position, upper portions of the lever 15 have come into contact with stops 27 and *27a*, which are firmly attached to the venetian blind carriage. Also, the cut-out 21 in lever 15 has moved leftward, so that the pin 29, which is also firmly attached to the venetian blind carriage, is at the extreme upper-right end of the cut-out 21. In this position, the lever 15 is held rigidly against the stops 27 and *27a*. Thus, as the chain 11 moves upward, the carriage moves upward with it.

Figure 7B:
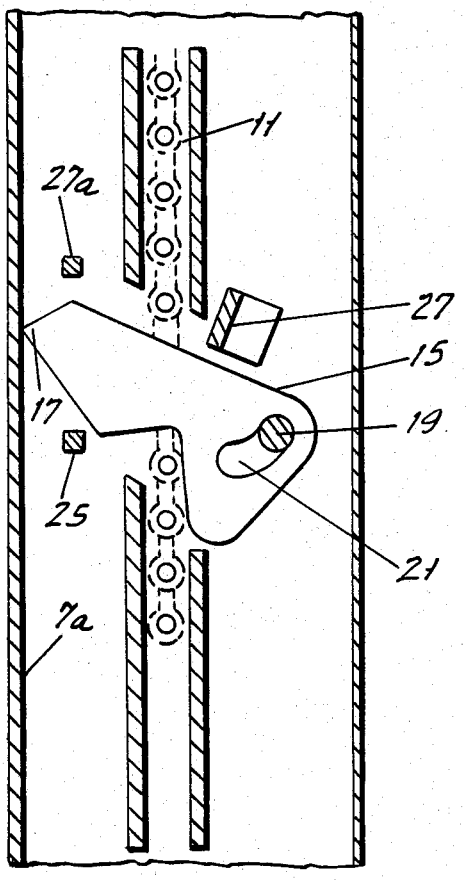

Referring to FIG. 7B, lever 15 is seen in its position after the carriage has been moved downward by lowering the chain 11. The carriage has reached a downward stopping place; for example, it has come to rest against a window sill. In this position, the pin 13 has moved downward with chain 11 and is not longer in contact with the lever 15. For that reason, pin 13 is not shown in FIG. 7B. Since lever 15 is no longer supported by pin 13, it has rotated counterclockwise slightly, about the pin 19, from its position in FIG. 7A, under the force of its own wieght. Accordingly, the lever 15 no longer has its upper portions in contact with the stops 27 and *27a*, but instead has its locking edge 17 resting in contact with the vertical locking abument *7a* to the left of the carriage.

Under repeated operations of lifting and lowering the venetian blind by raising the chain 11, the lever 15 would simply alternate between the positions in FIG. 7A and FIG. 7B. In other words, when the blind is lifted, the pin 13 would engage the lever 15 at recess 29, and thereby raise the venetian blind. Upon lowering the chain 11 to lower the blind, the pin 13 would support the lever 15 in the same position (FIG. 7A) until the carriage reached the window sill. At that point, the pin 13 would continue its travel downward below the lever 15, and the lever 15 would rotate counterclockwise until the locking edge 17 came to rest in loose contact with the locking abutment *7a*.

Figure 7C:
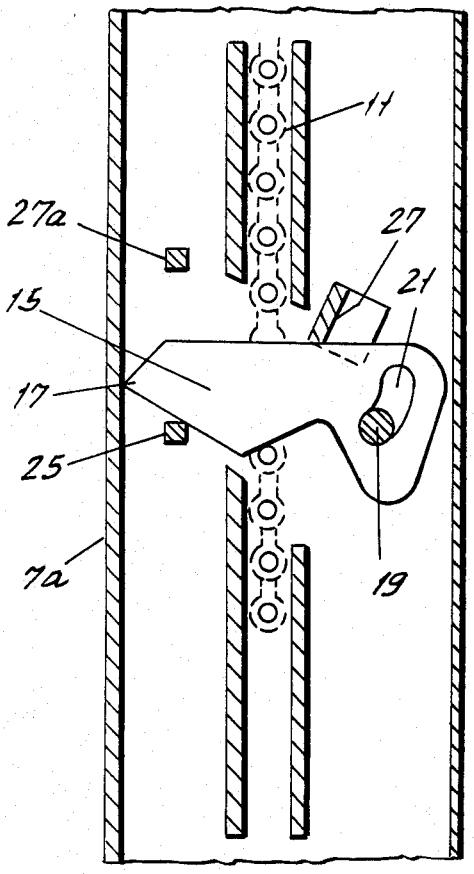

In addition to the above, however, the unusual case in which an intruder, for example, attempts to raise the venetian blind without raising the chain 11 in the normal way is shown in FIG. 7C. Note that in the normal case (FIGS. 7A and 7B), at the first instant the pin 13 moves upward and engages the lever 15, the locking edge 17 is rotated clockwise away from the locking abutment *7a*. FIG. 7C represents the exceptional condition when this has not occurred. Rather, it has been attempted to raise the venetian blind with the locking edge 17 still in contact with the locking abutment *7a*. As the carriage is raised, the pin 19 fixed to the carriage is also raised. Thus, the right-hand portion of the lever 15 is raised by the pin 19. Since the locking edge 17 is in contact with locking abutment *7a*, the left-hand end of the lever cannot move upward. Rather, the entire lever 1, under this action, rotates counterclockwise. Such rotation forces the lever 15 rightward. The cut-out 21 moves rightward with the rest of the lever 15, so the pin 19 moves to the lower-left extremity of the cut-out 21. The right-hand portion of the lever 15 moves upward slightly until it comes into contact with the stop 27. The lever's rotation counterclockwise is similarly stopped by its lower-left portion contacting the stop 25.

In this position, shown in FIG. 7C, the locking edge 17 has been forced into a locked or wedged contact with the locking abutment *7a*. If the carriage were moved further upward, the lever 15 would tend to rotate further counterclockwise, but is stopped from such movement by the stops 25 and 27. Accordingly, the entire carriage is prevented from further upward movement. This achieves the important object of the invention of preventing unauthorized access to a window from the outside, in which an intruder attempts to raise the carriage without correspondingly raising the chain 11 in the normal way.

Figure 3:
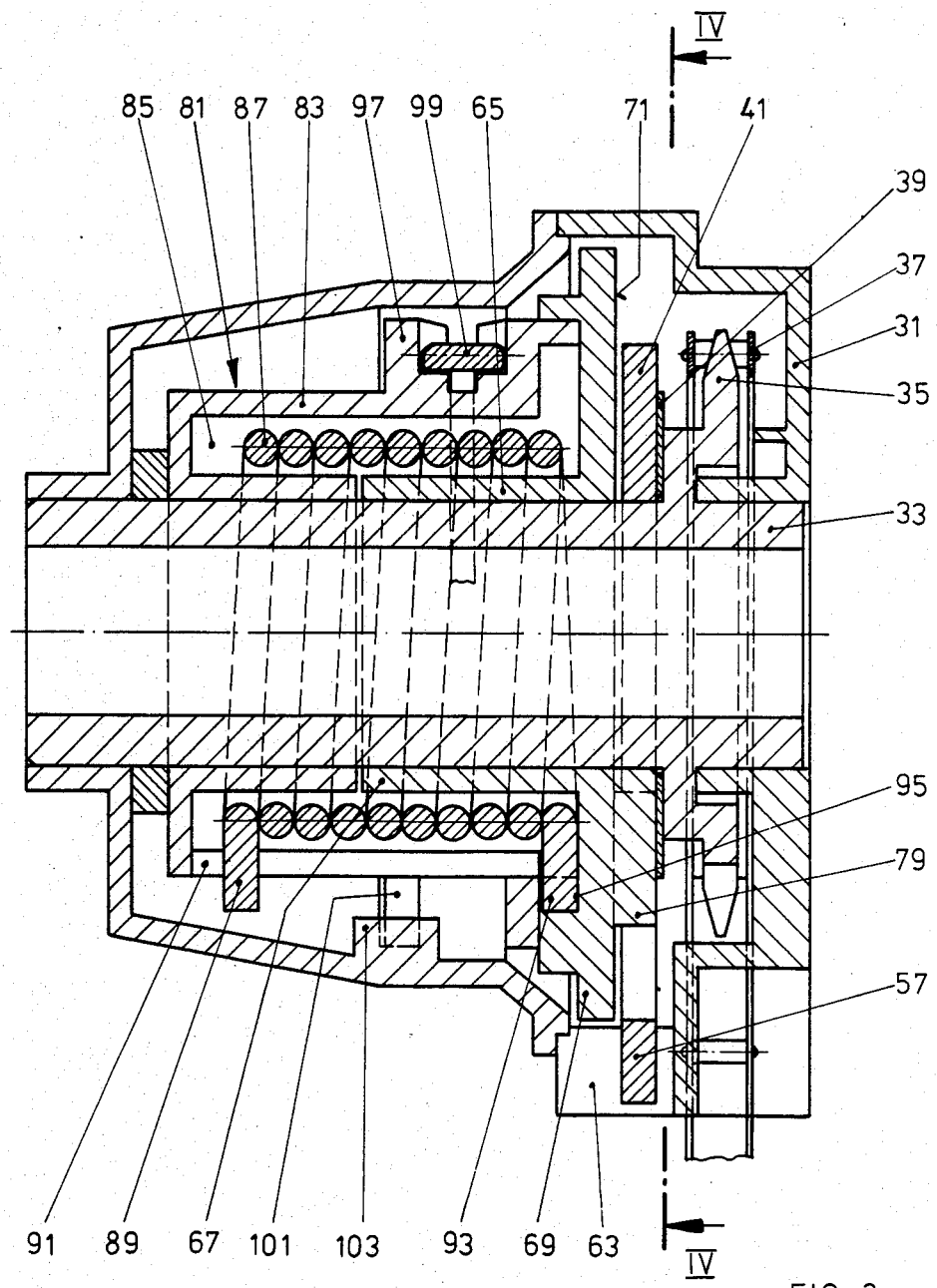
FIG. 3 is a longitudinal section through a drive transmission in accordance with the invention.
Figure 4:
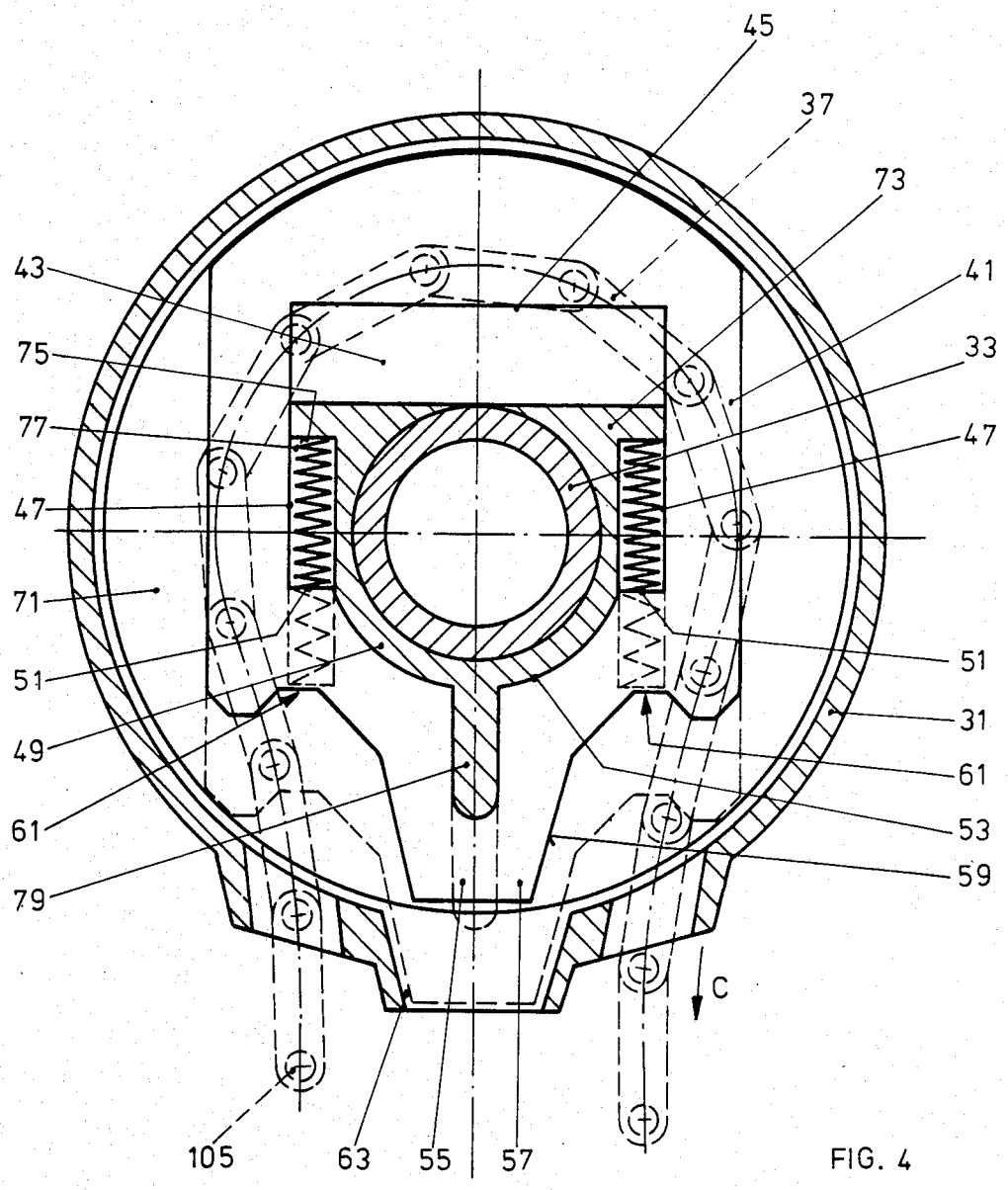
FIG. 4 is a section along the line IV—IV of FIG. 3 through the drive transmission in accordance with the invention.

The drive transmission for a venetian blind in accordance with the invention is shown in FIGS. 3 and 4. A housing 31 is mounted so that it cannot rotate on the blind housing (not shown). A hollow shaft 33 is rotatably supported in housing 31. Within a cavity defined inside shaft 33 is an axially extending and axially fixed drive shaft (not shown) of a drive for the blind. At one end, the hollow shaft 33 bears a sprocket wheel 35 on which a chain 37 similar to the chain 11 of FIGS. 1 and 2 travels in a driven manner. Chain 37 extends downward from sprocket wheel 35 on both sides. The chain 37 drives the raising and lowering movements of the blind.

As can be seen in the particular in FIG. 4, a slide 41 is seated axially adjacent to a washer 39 on the sprocket wheel 35, all on the hollow shaft 33. In FIG. 4, the chain 37 lying in front of the plane of the figure is shown in dashed line. The slide 41, acting as a coupling element between sprocket wheel 35 on the hollow shaft 33 and a transmitter, to be described below, has a central opening 43 surrounding the hollow shaft 33. The upper edge 45 and side edges 47 of opening 43 form a rectangular figure. The lower edge 49 is formed by two support surfaces 51 extending inward from the side edges 47 and an arcuate edge 53 adjoining surfaces 51. Arcuate edge 53 has a radius of curvature which corresponds to the outside radius of the hollow shaft 33. A guide groove 55 extends vertically downward from the arcuate edge 53 along the vertical axis of symmetry of the slide 41. Extending downward the slide 41 comprises a basically trapezoidally shaped stop 57 on. Stop surfaces 59 define trapezoidal stop 57 on each side. On both sides of the stop surfaces 59 are chain-bolt recesses 61. The housing 31 has a receiving opening 63 for the stop 57 aligned axially with stop 57.

As shown in FIG. 3, a transmitter 65 axially adjoins slide 41. Transmitter 65 rides for rotary movement on the hollow shaft 33. Transmitter 65 includes a disk-shaped flange 69 which extends from a cylindrical section 67 around the hollow shaft 33 and which axially faces slide 41. The slide 41 slides on the guide surface 71 of the flange 69 which faces it. This guide surface 71 has a guide development 73 which extends into the central opening 43 of the slide 41. As can be seen in particular in FIG. 4, this development 73 defines opposing support surfaces 75 for springs 77, aligned vertically on each side with the bearing surfaces 51 on the slide 41.

Aligned with the guide groove 55 of the slide 41 is a torque transmission projection 79 on the development 73, dimensioned for engagement with the groove 55. As can be seen in FIG. 4, the slide 41 can thus be pushed linearly up and down in a vertical direction and is pressed by the spring 77 into the lower position shown in dashed line in the figure. When slide 41 is pushed up, the torque transmission projection 79 slides further into the guide groove 55. Furthermore, the outer edge of the slide 41 is shaped so that it does not extend anywhere beyond the flange 69 of the transmitter 65 when it is pushed into the upper position shown in solid line in FIG. 4.

Axially adjoining the transmitter 65 is a tilt drive bushing 81 which is mounted for rotation on a part of the hollow shaft 33. In addition, tilt drive bushing 81 has an outer cylindrical wall 83 which extends axially beyond the hollow-shaft section 67 of the transmitter 65 in such a manner that a closed receiving chamber 85 is formed between transmitter 65 and tilt drive bushing 81.

A torsion spring 87 is located in the closed receiving chamber 85. A first end 89 of the torsion spring 87 extends radially through a driver groove 91 extending axially in the outer cylindrical wall 83 while an opposite second end 93 of the torsion spring 87 is positioned in a recess 95 on the side of the flange 69 facing away from the slide 41. The driver groove 91 and the recess 95 are so shaped that the torsion-spring ends 89 and 93 are locked in both directions of rotation with a limited amount of play.

An attachment 97 for a tilt drive belt 99 extending around the outlet cylindrical wall 83 is provided on that outer cylindrical wall 83 of the tilt drive bushing 81. The drive belt 99 drives the swinging or tilting of the slats of the blind. Furthermore, on the outer-cylindrical wall 83 is a stop 101 which limits the rotation of the tilt drive bushing 81 with respect to the housing 31 in both directions of rotation in cooperation with counter-stop surfaces 103 provided on the housing inner wall.

This drive transmission operates as follows: For the raising or lowering of the slats of the blind, the chain 37 is driven by hollow shaft 33 and sprocket wheel 35. In this case, the slide 41 is driven by the springs 77 into the lower position shown in dashed line in FIG. 4. The stop surfaces 59 of stop 57 extend into the receiving opening 63 of the housing 31. Stop 57 prevents any rotary movement of itself and thus of the transmitter 65 and of the tilt drive bushing 81 with respect to the housing 31.

Shortly before the blind is lowered into its lowermost position, a chain end projection 105 engages the corresponding chain-bolt recess 61 of the slide 41, as chain 37 moves in lowering direction C as shown in FIG. 4. Slide 41 is thus lifted against the action of the spring 77 by further movement of the chain in lowering direction C such that stop 57 disengages from the receiving opening 63 on the housing 31.

During this pushing up of the slide 41, the torque-transmission projection 79 on the transmission flange 69 is also completely pushed into the guide groove 55 of slide 41. Therefore, the further movement of the traveling chain 37 is now directly transmitted by end projection 105, slide 41 and groove-projection connection 55, 79 to the transmitter 65. The turning movement of the transmitter 65 which now take place is further transmitted by the edge surfaces of the recess 95 to the first end 93 of the torsion spring and then by its second end 89, through the corresponding edge surface of the groove 91, to the tilt drive bushing 81. Attachment 97 is rotated causing the tilt drive belt 99 to effect a tilting or swinging of the slats of the blind. The torsion spring 87, which has a suitably designed spring constant, acts as a nearly rigid rotary connection between the transmitter 65 and the tilt drive bushing 81.

The swinging of the tilt drive bushing 81 is mechanically stopped when the stop 101 on the outer cylinder wall 83 comes against the counter-stop 103 on the housing 31. The relative position of angular rotation of stop 101 and counterstop 103 is such that in the stopped position the slats are tilted to the point where further tilting must be avoided. This positioning is effected by the aforementioned mechanical stop.

A drive member such as an electric motor which turns the hollow shaft 33 on the sprocket wheel 35 can ordinarily not be brought to a standstill precisely in a predetermined position but continues beyond this desired position. Therefore, torsion spring 87 acts as a brake on this drive member and as an overrun protection for the entire drive device. If the tilt drive bushing 81 is mechanically stopped from rotating with respect to the housing 31, as described, the transmitter 65, still rigidly connected via slide 41 to the sprocket wheel 35, can be moved further against the force of the spring 87. Therefore, further rotation of the motor cannot lead to any damage to the blind or to the drive transmission.

When the drive motor has come to rest, the restoring force of the spring 87 moves the shaft of transmitter 65 back by the overrun distance. Analogous processes occur when the slats of the blind come into the upper position of the blind. In such a case a chain starting projection (not shown), analogous to projection 105, engages into the second chain bolt recess 61, whereupon the same connection operations take place in reverse rotary direction.

The drive transmission described above is relatively compact and simple in construction. Virtually no additional moments of load are produced for the drive motor, aside from those which must always be overcome for lowering or raising and tilting the slats of the blind. Furthermore, overrun protection is provided for the motor.

In situations when the tilt drive for the slats is connected almost rigidly to the drive of the blind, as with an electric motor, there is the danger that the blind will be damaged if the lowermost slat of the blind is impaired in its swinging movement by any object. To counteract this danger, an anti-twist safety as shown in FIGS. 5 and 6 is provided.

Figure 5:
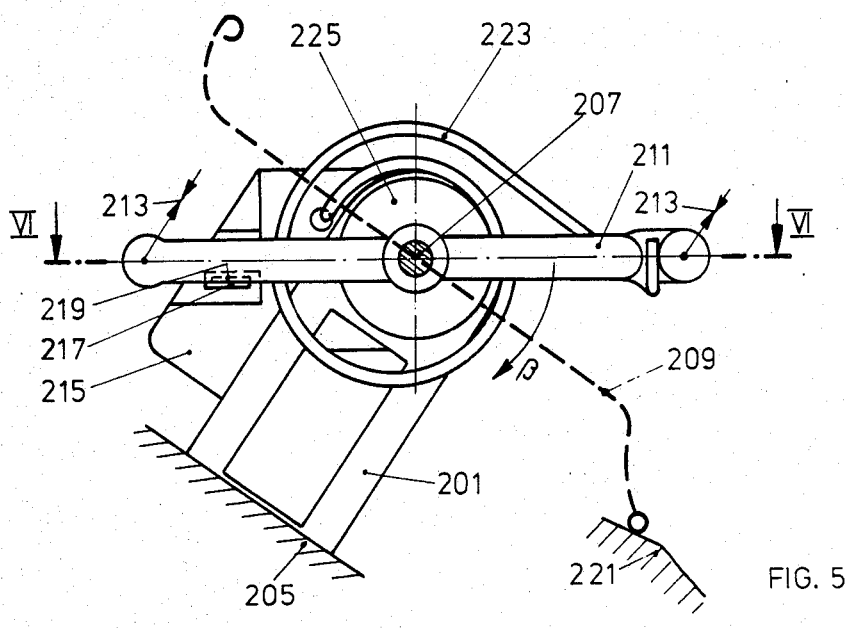
FIG. 5 is a side view of an anti-twist safety device of the invention.

As shown in FIG. 5, the rotary torsion safety may be provided for the lowermost slat of the blind. The anti-twist safety comprises a mounting part 201 which is fastened on a blind end carriage 205 which is movable linearly upwardly and downwardly in guides on the blind housing. A journal pin 207 for a blind slat 209, shown in dashed line, passes through and is rotatably movable, on this mounting part. A tilt lever 211, which is also movable in rotation, rides on the journal pin 207. On the two ends of the tilt lever 211 are engaged tilt drive members 213 of the blind, shown schematically. These are for the tilting down of the blinds. They are, for instance, pull straps or scissor members.

Figure 6:
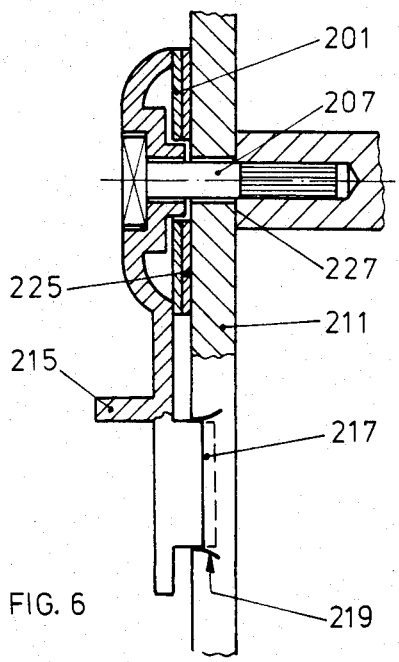
FIG. 6 is a sectional view through the anti-twist safety device of FIG. 5 along the line VI—VI.

As can be noted from FIG. 6, on the side opposite the mounting part 201 with respect to the slat 209, a driver 215 is rigidly connected with the journal pin 207 which extends through the mounting part 201. On the driver 215, there is a pawl projection 217. Upon corresponding swinging of the driver 215 and thus of the slat 209 relative to the tilting lever 211, the projection 217 snaps under spring action into a pawl 219 that is correspondingly formed on lever 211. In FIG. 5, the position of the tilt lever 211 of the slat 209 and thus also of the drive 215 is shown when the pawl connection 217, 219 is engaged between slat 209 and tilt lever 211. This pawl connection establishes a rotary connection between the tilt lever 211 and the slat 209 so that, with the tilt drive members 213 acting on the end of the tilt lever 211, the slat 209 an be swung in the direction indicated by $\beta$.

If the swinging movement of the slat 209 is now made impossible by an obstacle shown schematically at 221, and if the tilting moment acting in direction $\beta$, which is exerted by the tilt drive members 213 on the tilt lever 211, increases beyond a predetermined amount, then the pawl connection 219, 217 disengages and releases the tilt lever 211 without driving the slat 209 for a tilting movement in direction $\beta$.

Figure 5A:
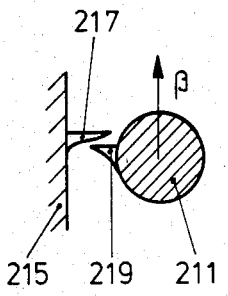
FIG. 5*a* is a detailed diagram of an engagement connection on the anti-twist safety device of FIG. 5.

FIG. 5*a* diagramatically shows one possible arrangement of the pawls 217, 219. The driver 215 is preferably made of plastic. The torque required to release the coupling between slat 209 and tilting lever 211 is determined by the elasticity of the pawl material on the driver-side resilient pawl 217 and by the shape of the pawl. A torsion spring 223 has one end resting against the tilting lever 211 and the other end resting against the driver 215. When the rotary connection of the tilting lever 211 and driver 215 is once released, for instance upon removal of the obstacle 221, the spring 223 swings the slat 209 into the tilted position that is assumed by the other slats which have not been impeded in their swing.

As can furthermore be noted from FIG. 6, the tilting lever 211 and the slat 209 are clamped with the mounting base 201 under axial spring action by a disk spring 225. Therefore, even when the connection between slat 209 and tilt lever 211 is released, the mounting of the slat is so damped with respect to swing vibrations that it cannot be caused to flutter by wind acting on the blind. Furthermore, the slat 209 which is then connected via the pawl connection 217, 219 to the tilt lever 211 does not flutter when the tilt lever 211 is not stabilized against rotation by the drive members 213 which are then loose. This situation is present when the slat 209 is not completely lowered.

As already mentioned, the anti-twist safety described is suitable for use together with the drive transmission described above, particularly if the tilt drive members for the blind slats are rigidly connected mechanically to a venetian blind drive.

Although the present invention has been described in connection with the plurality of preferred embodiments thereof, many other variations and modifications will now become apparent to those skilled in the art. It is preferred, therefore, that the present invention be limited not by the specific disclosure herein, but only by the appended claims.

What is claimed is:

1. A lift safety for a venetian blind, comprising:

a carraige for coupling to at least one slat of a venetian blind for moving therewith in a raising direction and a lowering direction opposite the raising direction, the carriage being movable in the raising and lowering directions along a stationary frame part of the venetian blind; and a lever on the carriage, the lever being swingable about a swing point in relation to the carriage, the lever further having an end portion spaced from the swing point and disposed toward the stationary frame part of the blind for contacting the stationary frame part; the swing point and the end portion defining a swing radius; the lever being further movable in relation to the carriage between an unlocked position and a locked position in which the swing radius forms an angle of about 90° with the raising direction for locking the lever with the end portion against the frame part of the blind; the length of the radius increasing as the lever approaches the locked position.

2. The lift safety of claim 1, in which the lever has a mortise defined therein, the carriage having a tenon for fitting into and swinging in the mortise for providing the swing point, the mortise having a first end for supporting the tenon when the lever is in the unlocked position and a second end opposite the first end for supporting the tenon when the lever is in the locked position; the mortise being curved between the first and second ends for decreasing the swing radius from the swing point to the end portion as the lever approaches the locked position.

3. The lift safety of claim 1, in which the carriage further has a downward stop thereon for stopping the lever from swinging downward from the locking position.

4. The lift safety of claim 1, further comprising engaging means on a lift drive of the blind for engaging the lever at an engagement point between the swing point and the end portion of the lever, the lever having an upper side; the carriage further having a upward stop thereon for abutting the upper side of the lever when the lever is in the locked position, the engagement point being disposed generally between the upward stop and the end portion of the lever for pivoting the lever about the upward stop when the engaging means pulls the lever in the raising direction from the locked position.

5. The lift safety of claim 4, in which the lever has a mortise defined therein, the carriage having a tenon for fitting into and swinging in the mortise for providing the swing point, the mortise having a first end for supporting the tenon when the lever is in the unlocked position and a second end opposite the first end for supporting the tenon when the lever is in the locked position; the mortise being curved near the second end approximately around the upward stop.

6. The lift safety of claim 1, in which the end portion of the lever has an edge thereon for contacting the frame part.

7. The lift safety of claim 1, in which one of the lever and the carriage has a mortise defined therein, the other of the lever and the carriage having a corresponding tenon for fitting into and swinging in the mortise for providing the swing point, the mortise having a first end for supporting the tenon when the lever is in the unlocked position and a second end opposite the first end for supporting the tenon when the lever is in the locked position; the mortise being curved between the first and second ends for decreasing the swing radius from the swing point to the end portion as the lever approaches the locked position.

8. The lift safety of claim 1, further comprising engaging means on a lift drive of the blind for engaging the lever at an engagement point between the swing point and the end portion of the lever, the lever having an upper side; the carriage further having an upward stop thereon for abutting the upper side of the lever when the lever is in the locked position, the engagement point being disposed generally between the upward stop and the end portion of the lever for pivoting the lever about the upward stop when the engaging means pulls the lever in the raising direction from the locked position;

in which one of the lever and the carriage has a mortise defined therein, the other of the lever and the carriage having a tenon for fitting into and swinging in the mortise for providing the swing point, the mortise having a first end for supporting the tenon when the lever is in the unlocked position and a second end opposite the first end for supporting the tenon when the lever is in the locked position; the mortise being curved near the second end approximately around the upward stop.

* * * * *